US011987275B2

(12) United States Patent
Tokumaru

(10) Patent No.: US 11,987,275 B2
(45) Date of Patent: May 21, 2024

(54) TRAIN CONTROL SYSTEM AND OBSTACLE DETECTION DEVICE

(71) Applicant: Mitsubishi Electric Corporation, Tokyo (JP)

(72) Inventor: Makoto Tokumaru, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 739 days.

(21) Appl. No.: 16/960,491

(22) PCT Filed: Jan. 12, 2018

(86) PCT No.: PCT/JP2018/000581
§ 371 (c)(1),
(2) Date: Jul. 7, 2020

(87) PCT Pub. No.: WO2019/138532
PCT Pub. Date: Jul. 18, 2019

(65) Prior Publication Data
US 2020/0377133 A1 Dec. 3, 2020

(51) Int. Cl.
*B61L 27/00* (2022.01)
*B61L 23/04* (2006.01)
(Continued)

(52) U.S. Cl.
CPC ..... *B61L 23/041* (2013.01); *B61L 25/021* (2013.01); *B61L 23/34* (2013.01); *B61L 2027/204* (2022.01)

(58) Field of Classification Search
CPC ..... B61L 23/041; B61L 25/021; B61L 23/34; B61L 2027/204; B61L 27/40
See application file for complete search history.

(56) References Cited

U.S. PATENT DOCUMENTS

2015/0239482 A1* 8/2015 Green ..... B61L 15/0063 246/122 R
2019/0114914 A1* 4/2019 Gao ..... G08G 1/096822
(Continued)

FOREIGN PATENT DOCUMENTS

JP 2010063260 A 3/2010
JP 2016088325 A * 5/2016
(Continued)

OTHER PUBLICATIONS

Vision Based Smart Driver Assisting System for Locomotives (Year: 2016).*
(Continued)

*Primary Examiner* — Adam R Mott
*Assistant Examiner* — Shaheda Shabnam Hoque
(74) *Attorney, Agent, or Firm* — BUCHANAN INGERSOLL & ROONEY PC

(57) ABSTRACT

A train control system includes: an image information conversion device that is mounted on a train and outputs first image information obtained by adding train information to image information imaged by an imaging device capable of capturing an area in front of the train; and an obstacle detection device that is installed on the ground and includes: an image information storage unit that records the first image information output from the image information conversion device; an image information comparison unit that compares the first image information with second image information recorded in the image information storage unit; and an image information result output unit that outputs a result from the image information comparison unit.

16 Claims, 15 Drawing Sheets

(51) Int. Cl.

| | |
|---|---|
| ***B61L 25/02*** | (2006.01) |
| *B61L 23/34* | (2006.01) |
| *B61L 27/20* | (2022.01) |

(56) References Cited

U.S. PATENT DOCUMENTS

| | | | | |
|---|---|---|---|---|
| 2019/0144025 | A1* | 5/2019 | Gao | B61L 21/10 701/19 |
| 2020/0184233 | A1* | 6/2020 | Berberian | G06V 20/588 |

FOREIGN PATENT DOCUMENTS

| | | | | |
|---|---|---|---|---|
| JP | 2016088325 | A | | 5/2016 |
| JP | 6001128 | B1 | * | 10/2016 |
| JP | 2016193669 | A | * | 11/2016 |
| JP | 2016193669 | A | | 11/2016 |
| JP | 2016199178 | A | * | 12/2016 |
| JP | 2016199178 | A | | 12/2016 |
| JP | 6494103 | B2 | * | 4/2019 |

OTHER PUBLICATIONS

Office Action dated May 27, 2021, for corresponding Indian Patent Application No. 202027028280, 5 pages.

International Search Report (PCT/ISA/210) dated Mar. 27, 2018, by the Japan Patent Office as the International Searching Authority for International Application No. PCT/JP2018/000581.

Written Opinion (PCT/ISA/237) dated Mar. 27, 2018, by the Japan Patent Office as the International Searching Authority for International Application No. PCT/JP2018/000581.

* cited by examiner

| | IMAGE CAPTURE TIME [HOUR : MINUTE : SECOND] | TRAIN LOCATION [km] | DEGREE OF MATCH [%] |
|---|---|---|---|
| ON-BOARD IMAGE INFORMATION A | 12 : 58 : 20 | 19.2 | 94 |
| ON-BOARD IMAGE INFORMATION A1 | 12 : 58 : 15 | 19.1 | 95 |
| ON-BOARD IMAGE INFORMATION A2 | 12 : 58 : 10 | 19.0 | 96 |

TRAIN CONTROL SYSTEM AND OBSTACLE DETECTION DEVICE

FIELD

The present invention relates to a train control system that performs obstacle detection.

BACKGROUND

There is known a technique for detecting an obstacle on a track of a train by capturing an image of an area in front of the train with a camera mounted on the train and comparing the captured image with an image recorded in the past (for example, see Patent Literature 1).

CITATION LIST

Patent Literature

Patent Literature 1: Japanese Patent Application Laid-open No. 2010-63260

SUMMARY

Technical Problem

However, conventional obstacle detection stores the captured image in a storage device installed in the train, thereby having had a problem of increase in the capacity of the storage device for recording images.

The present invention has been made to solve the above problem, and an object of the present invention is to reduce the capacity of a storage device mounted on a train for performing obstacle detection.

Solution to Problem

A train control system according to a first aspect of the invention includes: an image information conversion device mounted on a train to output first image information that is obtained by adding train information to image information imaged by an imaging device capable of capturing an area in front of the train; and an obstacle detection device installed on the ground and including: an image information storage unit to record the first image information output from the image information conversion device; an image information comparison unit to compare the first image information with second image information recorded in the image information storage unit; and an image information result output unit to output a result from the image information comparison unit.

An obstacle detection device according to a second aspect of the invention includes: an image information storage unit that is installed on the ground and records first image information; an image information comparison unit that determines a degree of match of image information by comparing the first image information with second image information recorded in the image information storage unit, and performs a second round of obstacle detection when the degree of match is greater than or equal to a second threshold and less than a first threshold; and an image information result output unit that outputs a result from the image information comparison unit.

Advantageous Effects of Invention

The train control system according to the present invention includes: the image information conversion device that is mounted on the train and outputs the first image information obtained by adding the train information to the image information imaged by the imaging device which is mounted on the train and capable of capturing the area in front of the train; and the obstacle detection device that is installed on the ground and includes the image information storage unit recording the first image information output from the image information conversion device, the image information comparison unit comparing the first image information with the second image information recorded in the image information storage unit, and the image information result output unit outputting the result from the image information comparison unit. Therefore, the train control system according to the present invention can reduce the capacity of the storage device mounted on the train for performing obstacle detection.

Furthermore, the obstacle detection device according to the present invention includes: the image information storage unit that is installed on the ground and records the first image information; the image information comparison unit that determines the degree of match of the image information by comparing the first image information with the second image information recorded in the image information storage unit, and performs the second round of obstacle detection when the degree of match is greater than or equal to the second threshold and less than the first threshold; and the image information result output unit that outputs the result from the image information comparison unit. Therefore, the obstacle detection device according to the present invention can reduce the capacity of the storage device mounted on the train for performing obstacle detection.

DESCRIPTION OF EMBODIMENTS

First Embodiment

Figure 1:
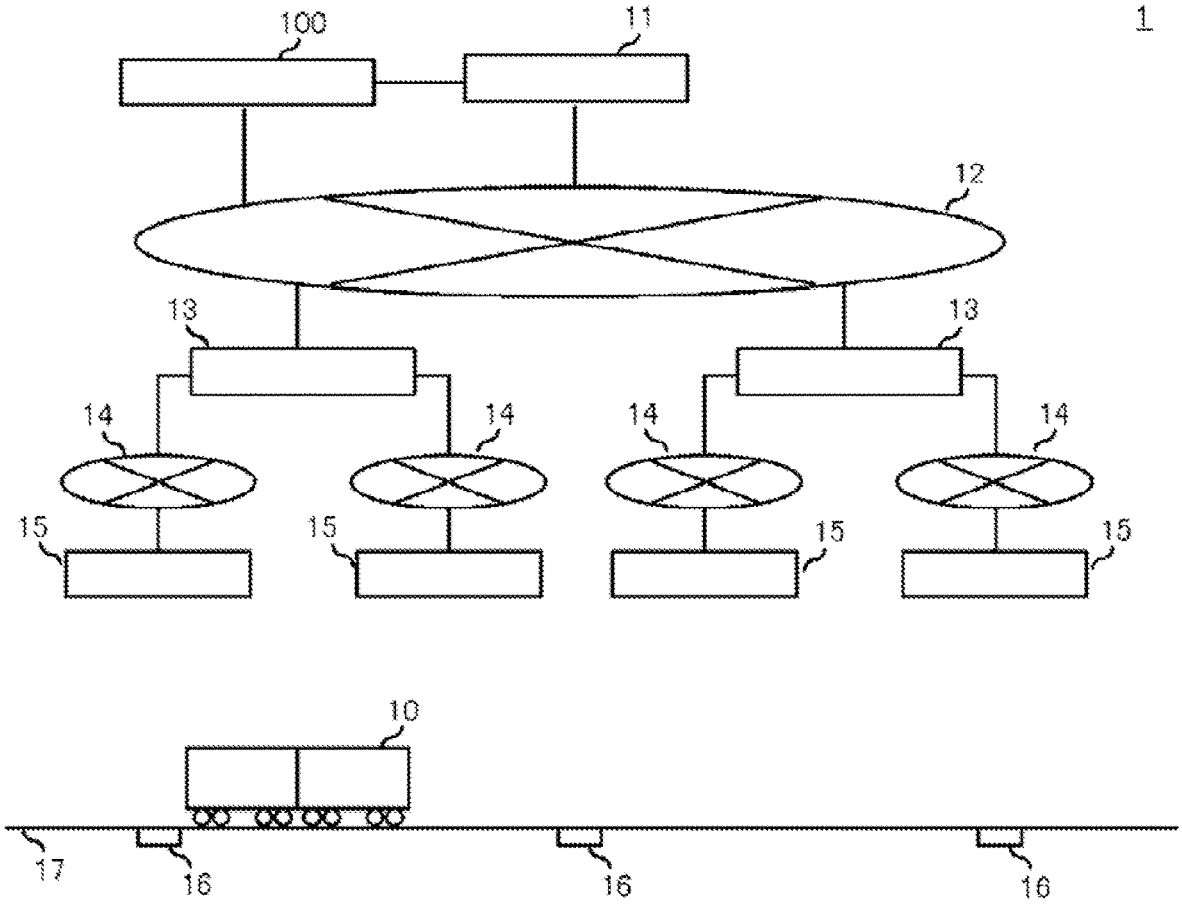
FIG. 1 is a diagram illustrating a schematic configuration of a train control system according to a first embodiment.

FIG. 1 is a diagram illustrating a schematic configuration of a train control system 1 according to a first embodiment of the present invention. The train control system 1 illustrated in FIG. 1 includes a train 10, an operation management device 11, ground control devices 13 connected to the operation management device 11 via a train control system network 12, wireless base stations 15 each connected to a corresponding one of the ground control devices 13 via a corresponding one of base networks 14, and an obstacle detection device 100.

In the train control system 1, a track 17 is divided into a plurality of control areas, and the ground control devices 13 manage the train 10 in the control areas.

The operation management device 11 monitors an operating status of the entire train control system 1, changes settings thereof, and so on. For example, the operation management device 11 sets a temporary speed limit.

The train control system network 12 is a network across the entire train control section, and connects the operation management device 11, the obstacle detection device 100, and the ground control devices 13.

One ground control device 13 is provided for each area. The ground control devices 13 each receive train location information from the train 10 via a corresponding one of the wireless base stations 15 and a corresponding one of the base networks 14, grasp the location of each train 10 from the train location information received, and transmit the information to the operation management device 11 via the train control system network 12. Also, the ground control devices 13 each receive operation management information of the train 10 from the operation management device 11, and transmit the operation management information received to the train 10 via the corresponding one of the base networks 14.

The ground control devices 13 each calculate a limit of movement authority (a position corresponding to a limit at which the train 10 is to be stopped) of the train 10 in the area on the basis of the train location information and course opening information from an interlocking control device (not illustrated). Information on the limit of movement authority calculated is transmitted to the train 10 via the corresponding one of the wireless base stations 15.

Here, the information on the limit of movement authority is information that is based on the location of the train 10 ahead and the position at which the train 10 is to be stopped, and that indicates, to the train 10 behind, the position being the limit at which the train 10 can be stopped safely. For example, when an obstacle or the like is on the track 17 on which the train 10 runs, the position of the obstacle is set as the position at which the train 10 is to be stopped.

Each of the base networks 14 is a network provided for each area, and connect each ground control device 13 to one or more of the wireless base stations 15.

The track 17 is a structure on the roadbed on which the train 10 runs. The operation of the train 10 is controlled by the train control system 1 illustrated in FIG. 1. On the track 17, a plurality of ground units 16 or position correcting ground units 16 to which IDs (ground unit information) are set is installed at intervals.

The wireless base stations 15 each communicate with an on-board wireless device 24, which is described later, of the train 10. In FIG. 1, two of the wireless base stations 15 are installed for one of the ground control devices 13, but the number thereof is not limited to two. One or three or more of the wireless base stations 15 may be installed for one of the ground control devices 13.

The obstacle detection device 100 is connected to the operation management device 11 and the train control system network 12. The obstacle detection device 100 detects an obstacle on the track 17 on which the train 10 runs. Details will be described later.

Figure 2:
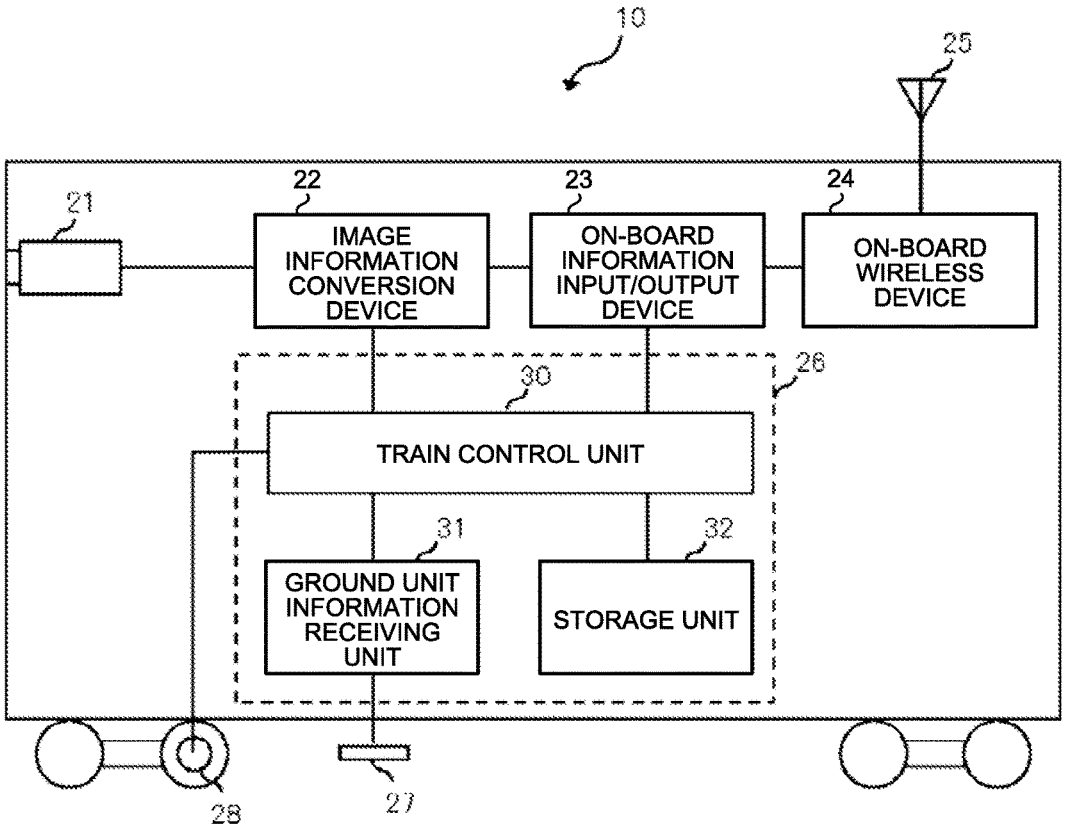
FIG. 2 is a diagram illustrating a schematic configuration of a car of the train control system according to the first embodiment.

FIG. 2 is a diagram illustrating a configuration of a car of the train 10 running in the train control system 1 according to the first embodiment. Note that although FIG. 2 illustrates only devices required for describing the train control system 1 according to the first embodiment, other devices and functions may be mounted.

The car illustrated in FIG. 2 includes the on-board wireless device 24, an on-board antenna 25, an on-board unit 27, an on-board control device 26, a tachometer generator 28, an imaging device 21, an image information conversion device 22, and an on-board information input/output device 23. The on-board control device 26 includes a train control unit 30, a ground unit information receiving unit 31, and a storage unit 32.

The storage unit 32 stores an on-board database (not illustrated). The on-board database stores information (track information) of the track 17 on which the train 10 runs. The information of the track 17 includes information on the kilometer distance at which each of the ground units 16 is installed (ground unit location information).

The on-board unit 27 detects the ID of any of the ground units 16 when passing over the ground unit 16 (when the on-board unit 27 and the ground unit 16 overlap). The ID is received by the ground unit information receiving unit 31 as the ground unit information. The ground unit information is output from the ground unit information receiving unit 31 to the train control unit 30.

The tachometer generator 28 generates a pulse corresponding to the rotational speed of a wheel, calculates the amount of travel and speed of the train 10, and outputs the calculated amount of travel and speed to the train control unit 30.

The train control unit 30 calculates the location of the train 10 on the basis of the amount of travel of the train 10 output from the tachometer generator 28 and the ground unit location information stored in the storage unit 32. The location of the train 10 calculated here is treated as the train location information. The train location information includes kilometer information, inbound/outbound line information, track number information in station premises, and the like. Moreover, the speed of the train 10 output from the tachometer generator 28 is treated as train speed information. The train control unit 30 is connected to the on-board information input/output device 23 and outputs the train location information, the train speed information, and the like to the on-board information input/output device 23.

The imaging device 21 is mounted on the first car and can capture an image of an area in front of the train 10. Specifically, the image of the area in front of the train 10 is captured at regular intervals and output to the image information conversion device 22. As the imaging device 21, for example, a camera, a video camera, or the like is suitable. Also, the number of the imaging devices 21 may be one or two or more. The imaging device 21 captures the image at every predetermined kilometer or every predetermined time set in advance. Moreover, the angle of image capture of the imaging device 21 is adjusted with respect to the head position of the train 10 such that the center of the image includes a position at which the train 10 can be stopped even if a certain extra distance is added when the train 10 travels at the maximum speed determined for the route, for example.

The image information conversion device 22 is connected to the imaging device 21, and can receive image information captured by the imaging device 21 from the imaging device 21. The image information conversion device 22 is also connected to the on-board control device 26, and can receive train information such as a train ID, the train location information, the train speed information, and train acceleration information from the on-board control device 26. The image information conversion device 22 generates new image information by adding the train information, which is received from the on-board control device 26, and the date and time of image capture to the image information received from the imaging device 21. Here, the new image information generated by the image information conversion device 22 is referred to as on-board image information. The image information conversion device 22 is connected to the on-board information input/output device 23, and outputs the on-board image information generated to the on-board information input/output device 23.

The on-board information input/output device 23 is connected to the on-board control device 26 and the image information conversion device 22. The on-board information input/output device 23 can receive the train information output from the on-board control device 26 and the like. The on-board information input/output device 23 can also receive the on-board image information output from the image information conversion device 22. The on-board information input/output device 23 outputs the train information and on-board image information received to the on-board wireless device 24.

The on-board wireless device 24 communicates with the wireless base station 15 corresponding to the current location of the train 10. Specifically, the information output from the on-board information input/output device 23 is transmitted to the corresponding wireless base station 15 via the on-board antenna 25. Also, the on-board wireless device 24 receives information output from a corresponding one of the ground control devices 13 via the corresponding wireless base station 15 using the on-board antenna 25, and outputs the information to the on-board information input/output device 23.

Figure 3:
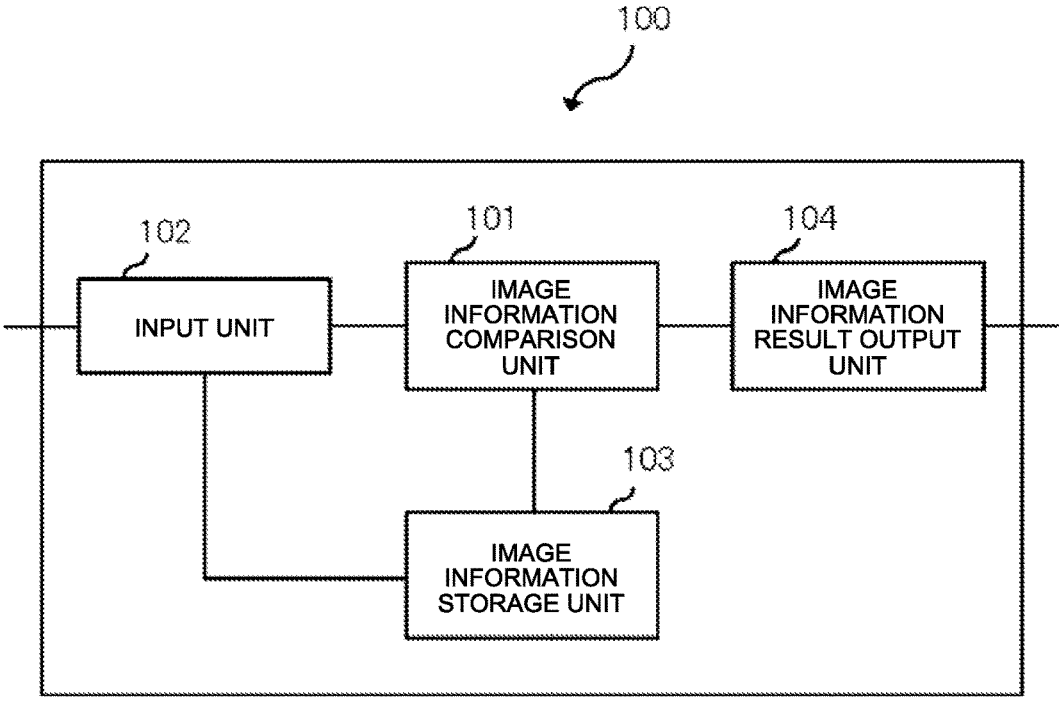
FIG. 3 is a diagram illustrating a configuration of an obstacle detection device of the train control system according to the first embodiment.

FIG. 3 is a diagram illustrating a configuration of the obstacle detection device 100 of the train control system 1 according to the first embodiment. Note that although FIG. 3 illustrates only devices required for describing the train control system 1 according to the first embodiment, other devices and functions may be mounted.

The obstacle detection device 100 illustrated in FIG. 3 includes an input unit 102, an image information storage unit 103, an image information comparison unit 101, and an image information result output unit 104.

The input unit 102 is connected to the train control system network 12, and can receive the on-board image information output from the train 10.

The image information storage unit 103 is connected to the input unit 102 and the image information comparison unit 101. The image information storage unit 103 stores and accumulates the on-board image information received by the input unit 102.

The image information comparison unit 101 is connected to the input unit 102 and the image information storage unit 103. The image information comparison unit 101 can receive the on-board image information from the input unit 102. The image information comparison unit 101 can also receive past on-board image information from the image information storage unit 103. The image information comparison unit 101 compares the on-board image information received from the input unit 102 with the past on-board image information received from the image information storage unit 103, and makes a determination on obstacle detection.

Here, the on-board image information received from the input unit 102 is referred to as on-board image information A, and the past on-board image information received from the image information storage unit 103 is referred to as on-board image information B. The on-board image information A and the on-board image information B have the same train location information. That is, the on-board image information A and the on-board image information B are image information captured at the same train location. Moreover, the on-board image information B may be image information captured by the train 10 that has generated the on-board image information A, or may be image information captured by a preceding train running in front of the train 10 that has generated the on-board image information A. In other words, train ID information added to the on-board image information A and B may be the same or different.

The image information comparison unit 101 compares the on-board image information A with the on-board image information B, and makes a determination on obstacle detection. In the determination on obstacle detection, it is determined whether or not an obstacle affecting the running of the train 10 is in front of the train. The image information comparison unit 101 is connected to the image information result output unit 104. When an obstacle has been detected, the image information comparison unit 101 outputs a result indicating the obstacle detection to the image information result output unit 104. In FIG. 3, the image information comparison unit 101 is configured to receive the on-board image information A from the input unit 102, but may receive the on-board image information A from the image information storage unit 103. When no obstacle has been detected, the image information comparison unit 101 may output a result indicating that no obstacle has been detected to the image information result output unit 104.

The image information result output unit 104 is connected to the image information comparison unit 101, and receives a result indicating obstacle detection when the image information comparison unit 101 has detected an obstacle. The image information result output unit 104 also outputs the result indicating the obstacle detection to the operation management device 11. The image information result output unit 104 and the operation management device 11 may be connected directly or may be connected via the train control system network 12.

Next, an operation of obstacle detection performed by the obstacle detection device 100 used in the train control system 1 according to the first embodiment will be described.

Figure 4:
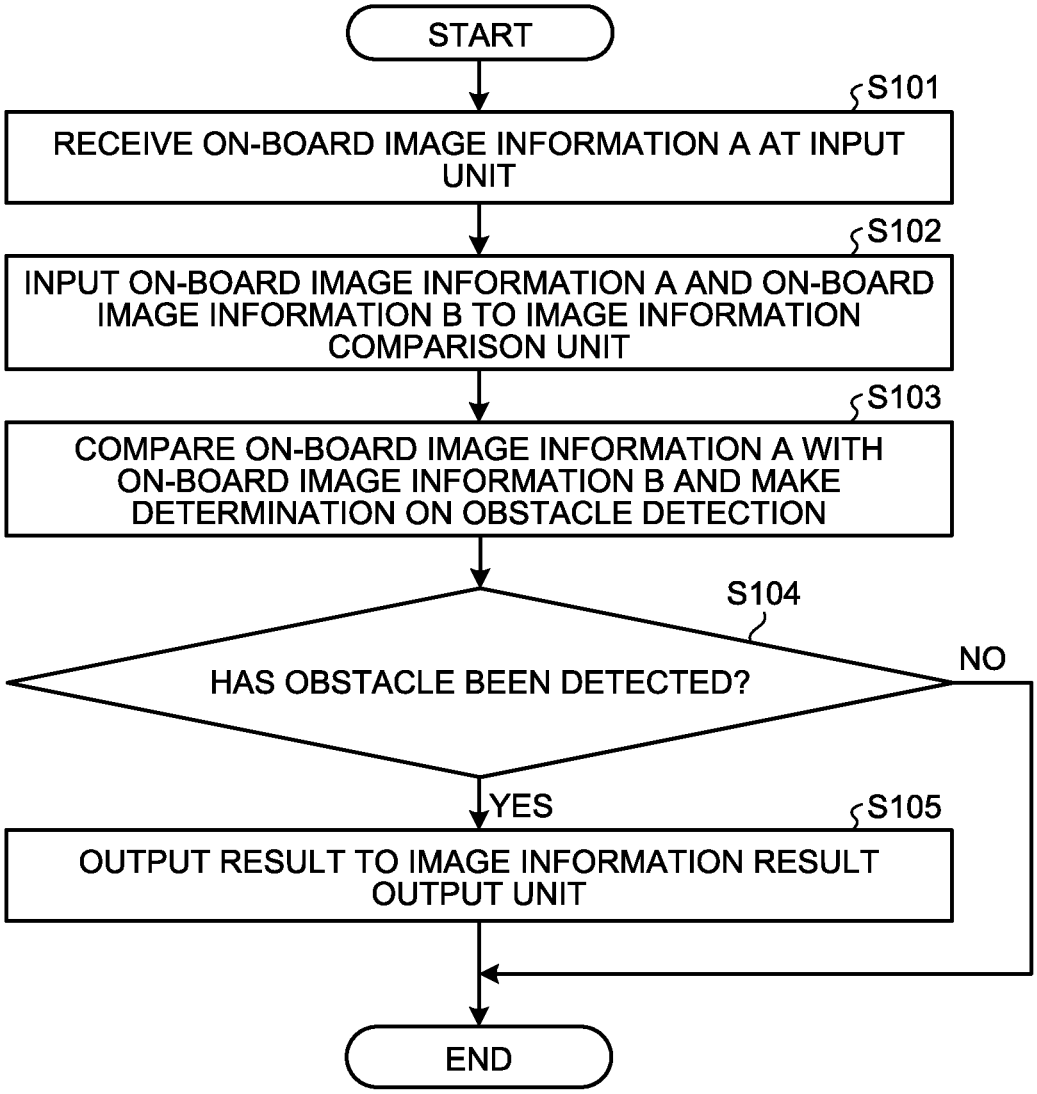
FIG. 4 is a flowchart illustrating an operation of the obstacle detection device of the train control system according to the first embodiment.

FIG. 4 is a flowchart illustrating the operation of obstacle detection performed by the obstacle detection device 100 used in the train control system 1 according to the first embodiment. First, the input unit 102 receives the on-board image information A output from the train 10 (S101). Next, the on-board image information A output from the input unit 102 and the on-board image information B output from the image information storage unit 103 are input to the image information comparison unit 101 (S102). The image information comparison unit 101 compares the on-board image information A with the on-board image information B, and makes a determination on obstacle detection (S103). If the image information comparison unit 101 has not detected an obstacle (No in S104), the obstacle detection is ended. If the image information comparison unit 101 has detected an obstacle (Yes in S104), a result indicating the obstacle detection is output to the image information result output unit 104 (S105).

Next, the determination on obstacle detection made by the obstacle detection device 100 used in the train control system 1 according to the first embodiment will be described.

Figure 5A:
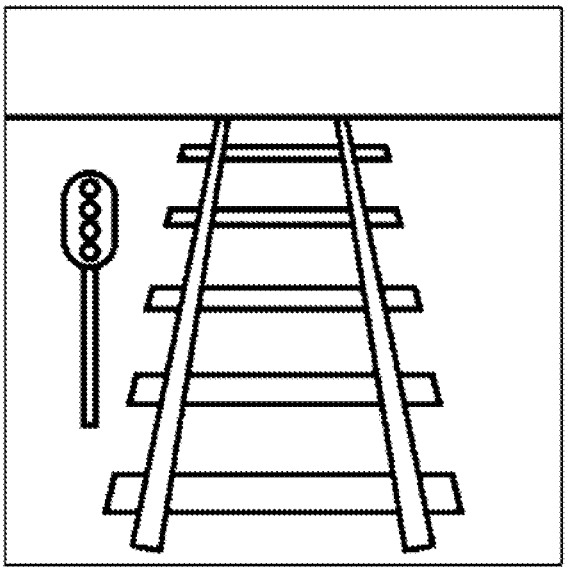
FIGS. 5(*a*) and 5(*b*) are diagrams illustrating an example of on-board image information of the train control system according to the first embodiment.
Figure 5B:
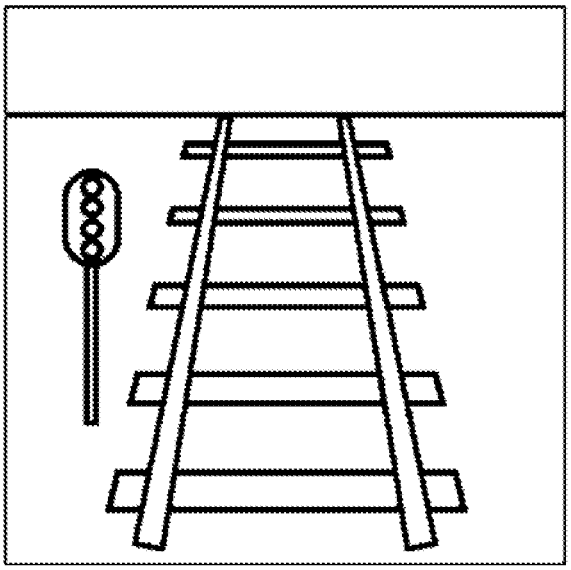

FIGS. 5(*a*) and 5(*b*) are diagrams illustrating the determination on obstacle detection made by the obstacle detection device 100 used in the train control system 1 according to the first embodiment. These figures illustrate a case where the obstacle detection device 100 does not detect an obstacle. FIG. 5(*a*) corresponds to the on-board image information A input to the image information comparison unit 101. FIG. 5(*b*) corresponds to the on-board image information B input to the image information comparison unit 101.

Figure 6A:
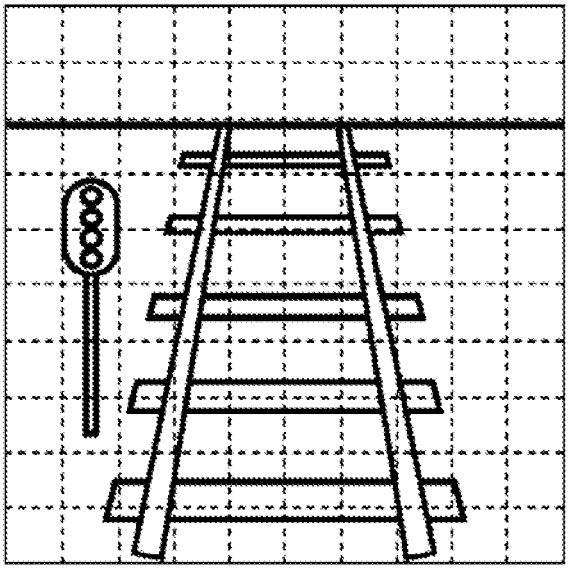
FIGS. 6(*a*) and 6(*b*) are diagrams illustrating another example of the on-board image information of the train control system according to the first embodiment.
Figure 6B:
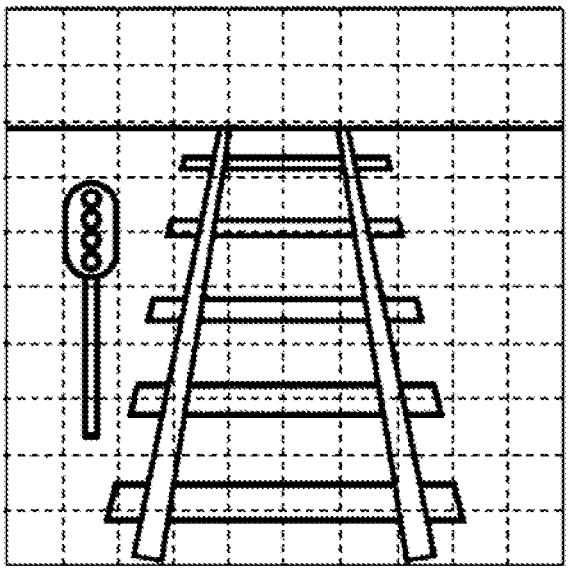

The image information comparison unit 101 divides the on-board image information into a plurality of areas to compare the on-board image information. FIGS. 6(*a*) and 6(*b*) are diagrams illustrating the on-board image information divided into the plurality of areas. FIG. 6(*a*) is a diagram illustrating an example in which the on-board image information A input to the image information comparison unit 101 is divided into the plurality of areas. FIG. 6(*b*) is a diagram illustrating an example in which the on-board image information B input to the image information comparison unit 101 is divided into the plurality of areas. In these figures, the on-board image information is divided into ten parts in each of vertical and horizontal directions to be divided into 100 areas. The number of divided areas is set as appropriate.

Among the divided areas in FIGS. 6(*a*) and 6(*b*), the area that is first from the left and first from the bottom is denoted as (1, 1). The area that is second from the left and first from the bottom is denoted as (2, 1). Similarly, each of the divided areas is denoted distinctively.

The image information comparison unit 101 compares (1, 1) of the on-board image information A with (1, 1) of the on-board image information B. Similarly, the 100 divided areas are compared. If a predetermined percentage or more of the image information matches as a result of comparing the divided areas, it is determined that there is no obstacle. In other words, the on-board image information A is compared with the on-board image information B, and if the degree of match therebetween is greater than or equal to a predetermined percentage, it is determined that there is no obstacle. If the degree of match is less than a predetermined percentage, it is determined that an obstacle has been detected. In other words, it is determined that there is no obstacle if the degree of match is greater than or equal to a predetermined first threshold, or that an obstacle has been detected if the degree of match is less than the first threshold.

Figure 7:
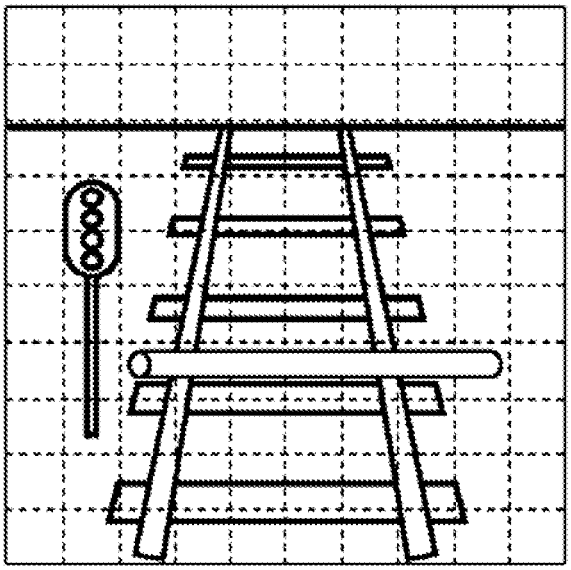
FIGS. 7(*a*) and 7(*b*) are diagrams illustrating yet another example of the on-board image information of the train control system according to the first embodiment.
Figure 7:
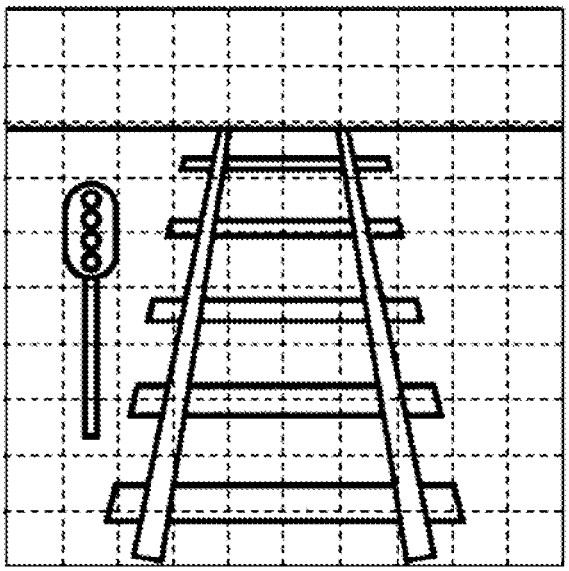

FIGS. 7(*a*) and 7(*b*) are diagrams illustrating a case where the obstacle detection device 100 detects an obstacle. FIG. 7(*a*) corresponds to the on-board image information A input to the image information comparison unit 101. FIG. 7(*b*) corresponds to the on-board image information B input to the image information comparison unit 101. Here, the degree of match for determining that an obstacle has been detected is set to a value, which is less than 98%.

As described above, the image information comparison unit 101 compares (1, 1) of the on-board image information A with (1, 1) of the on-board image information B. Similarly, the 100 divided areas are compared. As a result of comparing the divided areas, the on-board image information does not match in seven areas being (3, 4), (4, 4), . . . , and (9, 4). In this case, the degree of match is 93%, which is less than the degree of match of 98% for determining that an obstacle has been detected, whereby the image information comparison unit 101 determines that "an obstacle has been detected" and outputs the result to the image information result output unit 104. The image information result output unit 104 outputs the output result to the operation management device 11.

As described above, the determination on obstacle detection by the obstacle detection device 100 used in the train control system 1 according to the first embodiment is performed by the image information comparison unit 101 dividing each of the on-board image information A and the on-board image information B into the plurality of areas and comparing the areas between the on-board image information A and B. If the degree of match is greater than or equal to the predetermined percentage as a result of comparison between the on-board image information A and the on-board image information B, it is determined that there is no obstacle. If the degree of match is less than the predetermined percentage, it is determined that an obstacle has been detected, and the result is output to the image information result output unit 104. The image information result output unit 104 outputs the output result that "an obstacle has been detected" to the operation management device 11.

As described above, in the train control system 1 according to the first embodiment, the obstacle detection device 100 installed on the ground makes the determination on obstacle detection using the on-board image information captured by the train 10 and the past on-board image information. Therefore, the capacity of the storage device mounted on the train 10 can be reduced.

Figure 8:
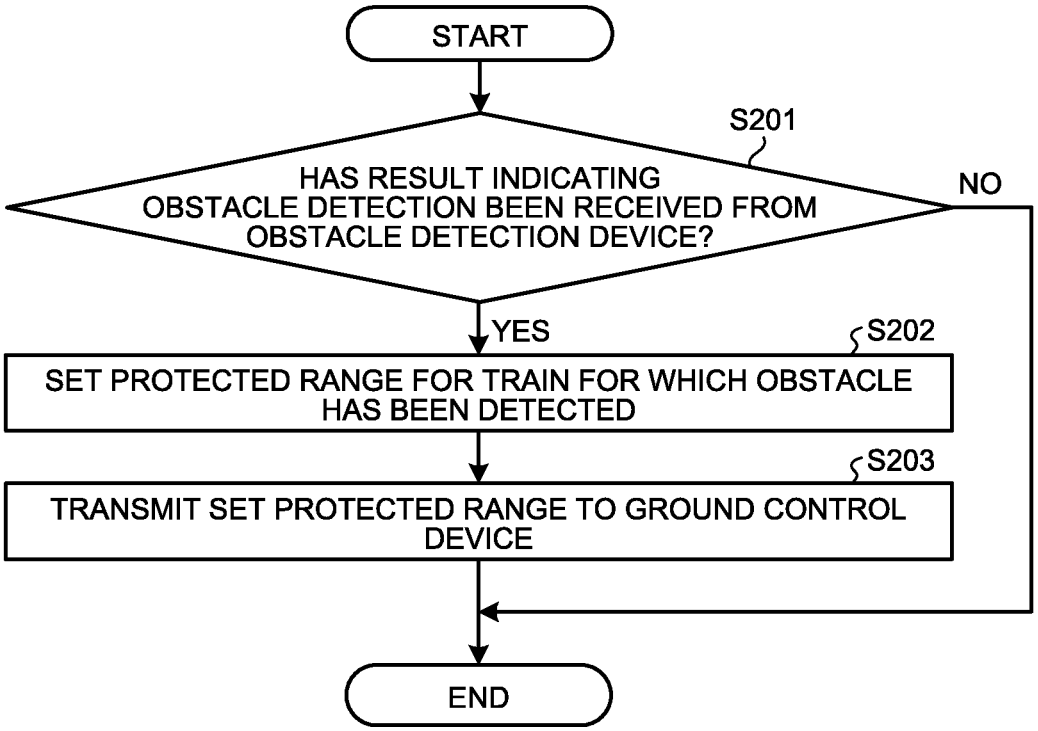
FIG. 8 is a flowchart illustrating an operation of an operation management device of the train control system according to the first embodiment.

Next, an operation of the operation management device 11 when the obstacle detection device 100 has detected an obstacle will be described. FIG. 8 is a flowchart illustrating the operation of the operation management device 11 used in the train control system 1 according to the first embodiment.

First, it is detected whether or not a result indicating the obstacle detection has been received from the obstacle detection device 100 (S201). The processing is ended if the result indicating the obstacle detection has not been received from the obstacle detection device 100 (No in S201). If the result indicating the obstacle detection has been received from the obstacle detection device 100 (Yes in S201), a protected range is set for the train 10 for which the obstacle has been detected (S202). Here, the protected range refers to a range where the train 10 can stop safely or a range where the train 10 can run safely. For example, the protected range for the train 10 is set up to just before the obstacle detected ahead in the direction of travel. Next, protected range information regarding the protected range being set is transmitted to a corresponding one of the ground control devices 13 via the train control system network 12 (S203).

The protected range may be set for the train 10 for which the obstacle has been detected and for a following train that runs behind the train 10 for which the obstacle has been detected.

By the operation management device 11 detecting that the obstacle has been detected, the safety of the train 10 running on the track 17 can be ensured.

Figure 9:
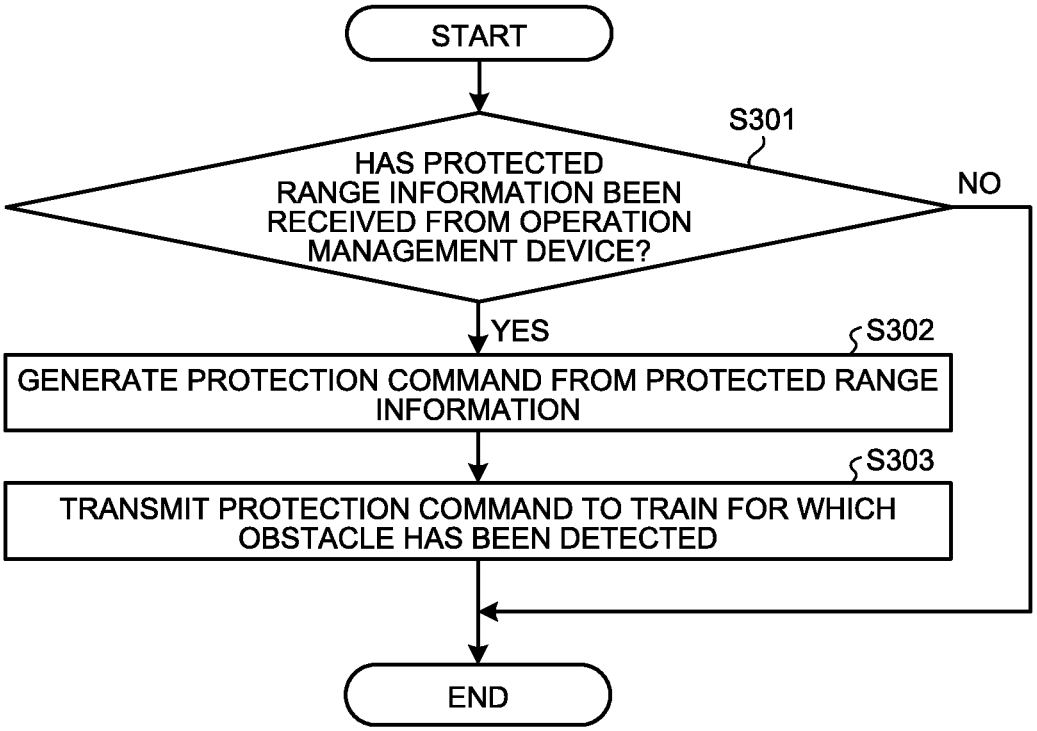
FIG. 9 is a flowchart illustrating an operation of a ground control device of the train control system according to the first embodiment.

Next, an operation of the ground control device 13 when the obstacle detection device 100 has detected an obstacle will be described. FIG. 9 is a flowchart illustrating the operation of the ground control device 13 used in the train control system 1 according to the first embodiment.

First, it is detected whether or not the protected range information has been received from the operation management device 11 (S301). The processing is ended if the protected range information has not been received from the operation management device 11 (No in S301). If the protected range information has been received from the operation management device 11 (Yes in S301), protection command information is generated (S302). Here, the protection command information refers to information which is transmitted to the train 10 and with which the train 10 can stop safely or run safely. The protection command information includes, for example, protected position information indicating a position that allows the train 10 to stop safely. Next, the protection command information generated is transmitted to the train 10 via a corresponding one of the base networks 14 (S303). Here, although the protection command information is transmitted to the train 10 wirelessly as illustrated in FIG. 1, the protection command information generated may be transmitted from the ground control device 13 to the train 10 via the ground unit(s) 16.

The protection command information may be transmitted to the train 10 for which the obstacle has been detected and to a following train that runs behind the train 10 for which the obstacle has been detected.

The on-board control device 26 of the train 10 that has received the protection command information generates a speed check pattern for the train 10 to decelerate and stop at the position at which the train can stop safely on the basis of the protected position information included in the protection command information. The train 10 decelerates according to the speed check pattern and stops before the obstacle in the direction of travel.

The train control system 1 according to the first embodiment includes: the image information conversion device 22 that is mounted on the train 10 and outputs first image information obtained by adding the train information to the image information imaged by the imaging device 21 which is mounted on the train 10 and capable of capturing the area in front of the train 10; and the obstacle detection device 100 that is installed on the ground and includes the image information storage unit 103 recording the first image information output from the image information conversion device 22, the image information comparison unit 101 comparing the first image information with second image information recorded in the image information storage unit 103, and the image information result output unit 104 outputting a result from the image information comparison unit 101. Therefore, the train control system 1 according to the first embodiment can reduce the capacity of the storage device mounted on the train 10 for performing obstacle detection.

Moreover, in the train control system 1 according to the first embodiment, the image information result output unit 104 outputs a result indicating obstacle detection when an obstacle lies in front of the train 10, whereby the capacity of the storage device mounted on the train 10 for performing obstacle detection can be reduced.

Furthermore, in the train control system 1 according to the first embodiment, the image information comparison unit 101 determines the degree of match of the image information, whereby the capacity of the storage device mounted on the train 10 for performing obstacle detection can be reduced.

Furthermore, in the train control system 1 according to the first embodiment, the image information comparison unit 101 determines that an obstacle has been detected when the degree of match is less than the first threshold, whereby the capacity of the storage device mounted on the train 10 for performing obstacle detection can be reduced.

Furthermore, the train control system 1 according to the first embodiment further includes the operation management device 11 that manages the operation of the train 10 and sets the protected range for the train 10 when receiving the result that an obstacle has been detected from the image information result output unit 104, whereby the capacity of the storage device mounted on the train 10 for performing obstacle detection can be reduced.

Second Embodiment

Figure 10:
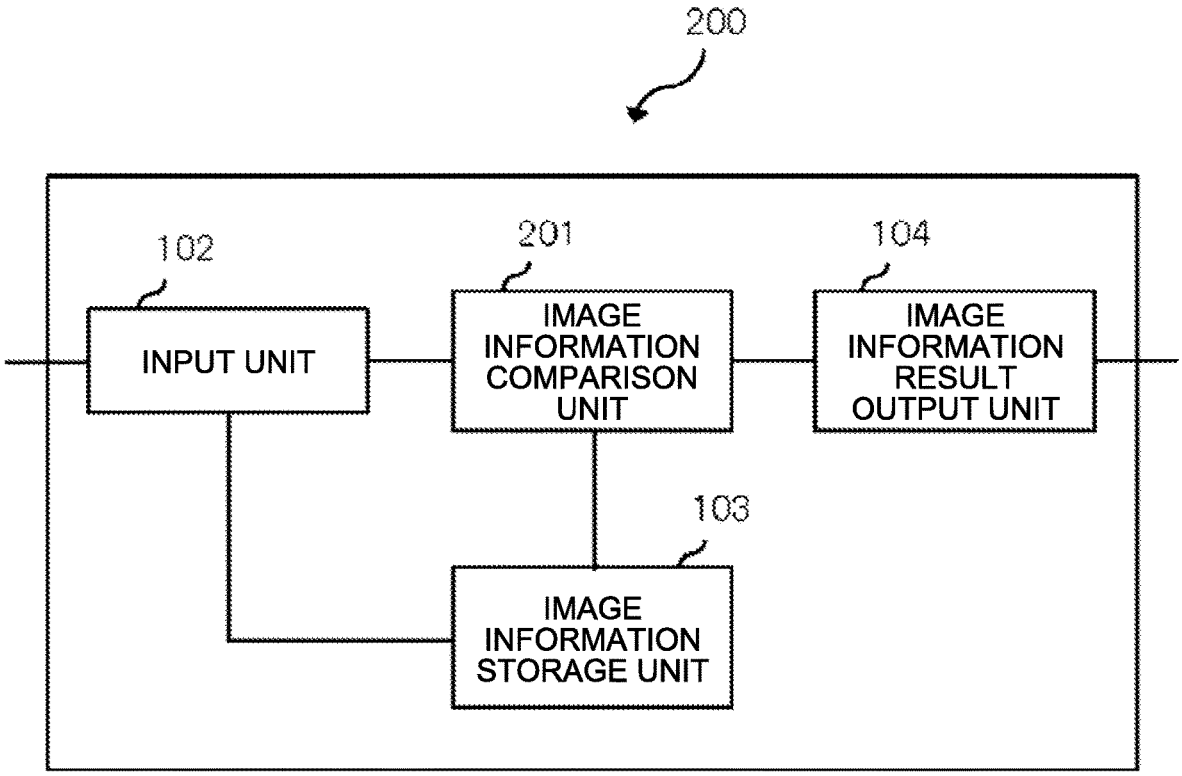
FIG. 10 is a diagram illustrating a configuration of an obstacle detection device of the train control system according to a second embodiment.

A second embodiment is characterized in that an obstacle detection device compares the on-board image information a plurality of times. FIG. 10 is a diagram illustrating a configuration of an obstacle detection device 200 of the train control system according to the second embodiment. Note that although FIG. 10 illustrates only devices required for describing the train control system according to the second embodiment, other devices and functions may be mounted. The basic configuration of FIG. 10 is similar to that of FIG. 3. The image information comparison unit 101 in FIG. 3 compares the on-board image information once, whereas an image information comparison unit 201 in FIG. 10 compares the on-board image information a plurality of times.

Figure 11:
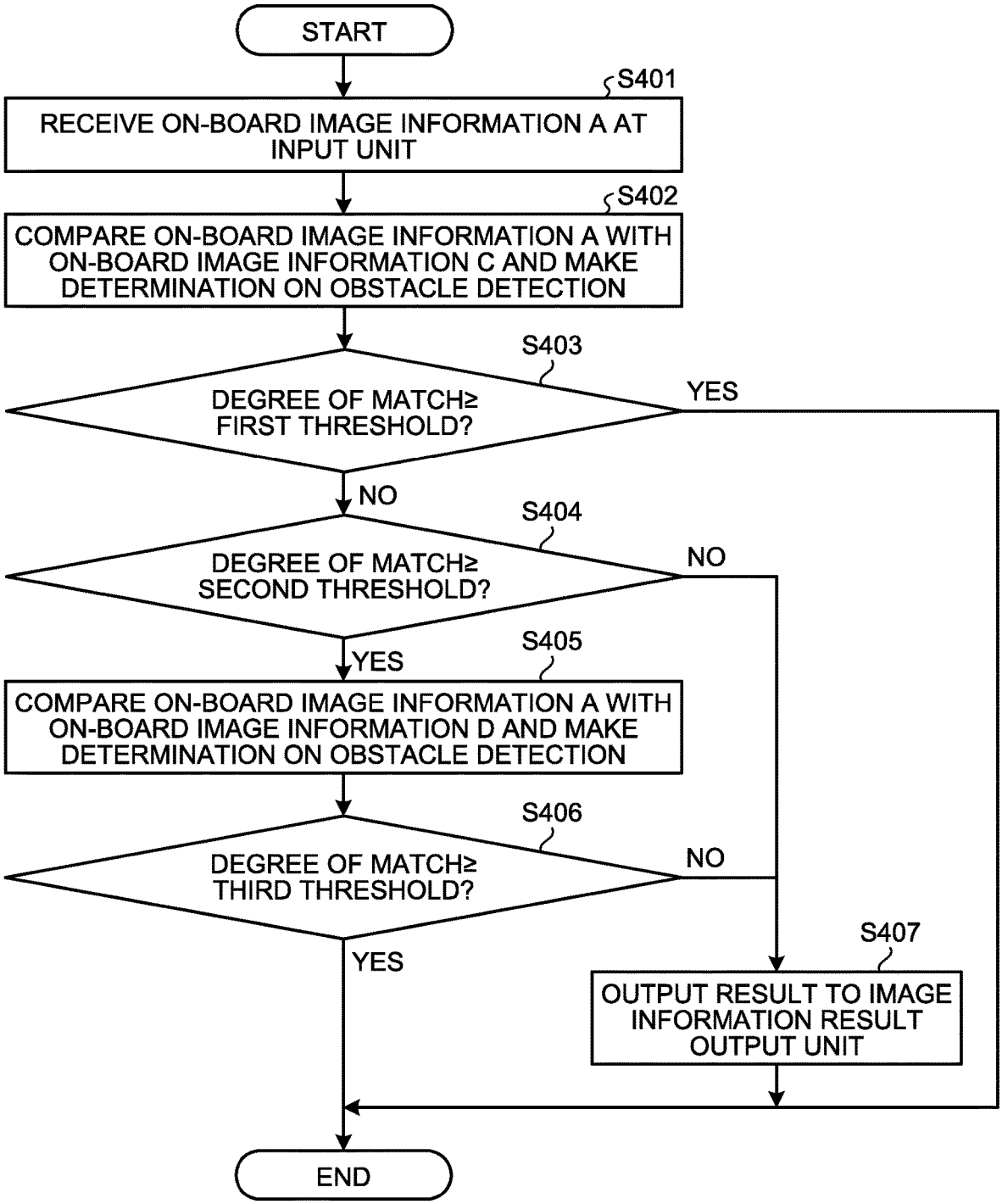
FIG. 11 is a flowchart illustrating an operation of the obstacle detection device of the train control system according to the second embodiment.

An operation of obstacle detection performed by the obstacle detection device 200 used in the train control system according to the second embodiment will be described. FIG. 11 is a flowchart illustrating the operation of obstacle detection performed by the obstacle detection device 200 used in the train control system according to the second embodiment. First, the input unit 102 receives the on-board image information A output from the train 10 (S401). Next, the image information comparison unit 201 compares the on-board image information A with on-board image information C, and makes a determination on obstacle detection (S402).

The on-board image information C is past on-board image information received from the image information storage unit 103. The on-board image information A and the on-board image information C have the same train location information. That is, the on-board image information A and the on-board image information C are image information captured at the same train location. Moreover, the on-board image information C may be image information captured by the train 10 that has generated the on-board image information A, or may be image information captured by a preceding train running in front of the train 10 that has generated the on-board image information A. In other words, train ID information added to the on-board image information A and C may be the same or different. In the following description, the past image information captured by the preceding train running in front of the train 10 that has generated the on-board image information A will be referred to as the on-board image information C.

The image information comparison unit 201 compares the on-board image information A with the on-board image information C, and makes a determination on obstacle detection in accordance with the degree of match. Specifically, the on-board image information A is compared with the on-board image information C, and it is determined whether or not the degree of match therebetween is greater than or equal to a predetermined first threshold. If the degree of match is greater than or equal to the first threshold (Yes in S403), the obstacle detection is ended determining that there is no obstacle. If the degree of match is less than the first threshold (No in S403), it is determined whether or not the degree of match is greater than or equal to a predetermined second threshold (S404). The second threshold is a value smaller than the first threshold. If the degree of match is less than the second threshold (No in S404), it is determined that an obstacle has been detected, and a result indicating the obstacle detection is output to the image information result output unit 104 (S407). The processing after the result indicating the obstacle detection has been output to the image information result output unit 104 is similar to that of the first embodiment. If the degree of match is greater than or equal to the second threshold (Yes in S404), the on-board image information A is compared with on-board image information D, and a determination on obstacle detection is made (S405).

The on-board image information D is past on-board image information received from the image information storage unit 103, and is on-board image information different from the on-board image information C. The on-board image information A and the on-board image information D have the same train location information. That is, the on-board image information A and the on-board image information D are image information captured at the same train location. Moreover, the on-board image information D may be image information captured by the train 10 that has generated the on-board image information A, or may be image information captured by a preceding train running in front of the train 10 that has generated the on-board image information A. In the following description, the image information captured by the train 10 that has generated the on-board image information A will be referred to as the on-board image information D.

The image information comparison unit 201 compares the on-board image information A with the on-board image information D and determines whether or not the degree of match therebetween is greater than or equal to a predetermined third threshold. If the degree of match is greater than or equal to the third threshold (Yes in S406), the obstacle detection is ended determining that there is no obstacle. The third threshold is a value greater than or equal to the second threshold. If the degree of match is less than the third threshold (No in S406), it is determined that an obstacle has been detected, and a result indicating the obstacle detection is output to the image information result output unit 104 (S407).

The train control system according to the second embodiment makes the determination on obstacle detection a plurality of times using the different image information having the same train location information. Although the above description has illustrated the example in which the determination on obstacle detection is made twice, the determination may be made three times or more. The determination made the plurality of times reduces false detection, and thus enables a more accurate determination on obstacle detection.

The train control system according to the second embodiment uses the on-board image information with the different train ID information in the first determination on obstacle detection and in the second and subsequent determinations on obstacle detection, thereby being able to eliminate false detection due to the angle of installation of the imaging device that is different depending on the train. False detection due to a deviation in the angle of installation of the imaging device depending on the train can be eliminated.

In the train control system according to the second embodiment, the image information comparison unit 201 performs obstacle detection by comparing the first image information with third image information recorded in the image information storage unit 103 when the degree of match is greater than or equal to the second threshold and less than the first threshold, whereby the capacity of the storage device mounted on the train 10 for performing obstacle detection can be reduced. Also, the determination made the plurality of times reduces false detection, and thus enables a more accurate determination on obstacle detection.

Furthermore, in the train control system according to the second embodiment, the image information comparison unit 201 determines that an obstacle has been detected when the degree of match is less than the third threshold, whereby the capacity of the storage device mounted on the train 10 for performing obstacle detection can be reduced. Also, the determination made the plurality of times reduces false detection, and thus enables a more accurate determination on obstacle detection.

Furthermore, the obstacle detection device 200 according to the second embodiment includes: the image information storage unit 103 that is installed on the ground and records the first image information; the image information comparison unit 201 that determines the degree of match of the image information by comparing the first image information with second image information recorded in the image information storage unit 103, and performs a second round of obstacle detection when the degree of match is greater than or equal to the second threshold and less than the first threshold; and the image information result output unit 104 that outputs the result from the image information comparison unit 201. Therefore, the obstacle detection device 200 according to the second embodiment can reduce the capacity of the storage device mounted on the train 10 for performing obstacle detection. Also, the determination made the plurality of times reduces false detection, and thus enables a more accurate determination on obstacle detection.

Furthermore, in the obstacle detection device 200 according to the second embodiment, the image information comparison unit 201 performs obstacle detection by comparing the first image information with the third image information recorded in the image information storage unit 103, whereby the capacity of the storage device mounted on the train 10 for performing obstacle detection can be reduced. Also, the determination made the plurality of times reduces false detection, and thus enables a more accurate determination on obstacle detection.

Third Embodiment

Figure 12:
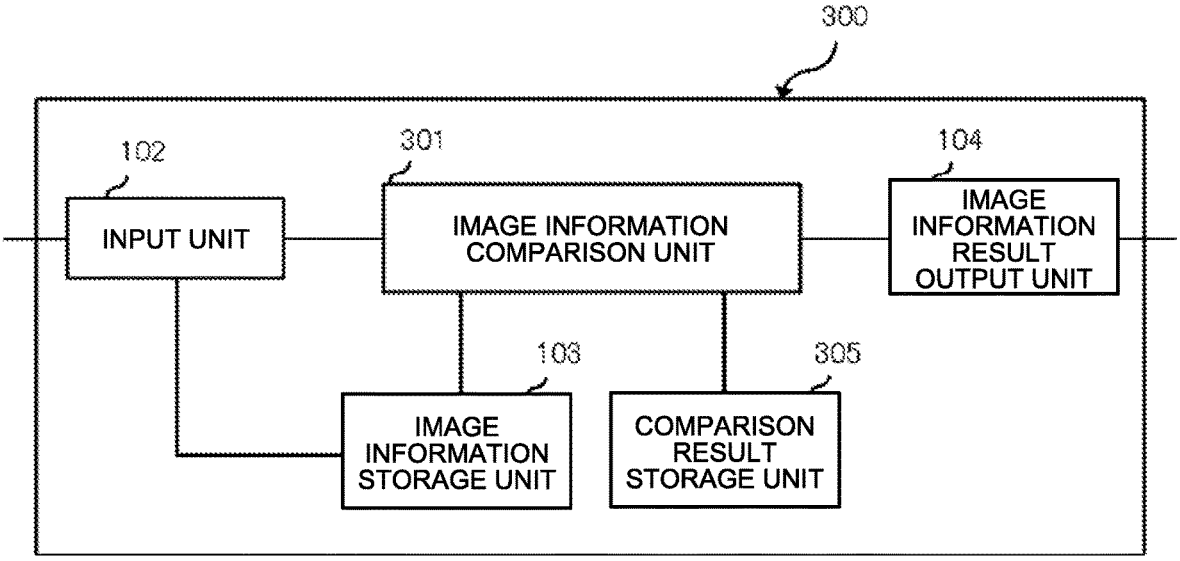
FIG. 12 is a diagram illustrating a configuration of an obstacle detection device of the train control system according to a third embodiment.

A third embodiment is characterized in that an obstacle detection device 300 uses on-board image information having different train location information, the on-board image information being captured by the train 10 for which a determination on obstacle detection is made. FIG. 12 is a diagram illustrating a configuration of the obstacle detection device 300 of the train control system according to the third embodiment. Note that although FIG. 12 illustrates only devices required for describing the train control system according to the third embodiment, other devices and functions may be mounted.

The obstacle detection device 300 illustrated in FIG. 12 includes the input unit 102, the image information storage unit 103, a comparison result storage unit 305, an image information comparison unit 301, and the image information result output unit 104. The comparison result storage unit 305 is connected to the image information comparison unit 301, and stores a result of comparison performed in the past by the image information comparison unit 301. The result of comparison performed in the past includes a record of the degree of match of the comparison performed in the past and the like. Here, the comparison result storage unit 305 is configured separately, but the image information storage unit 103 may include the comparison result storage unit 305.

Figure 13:
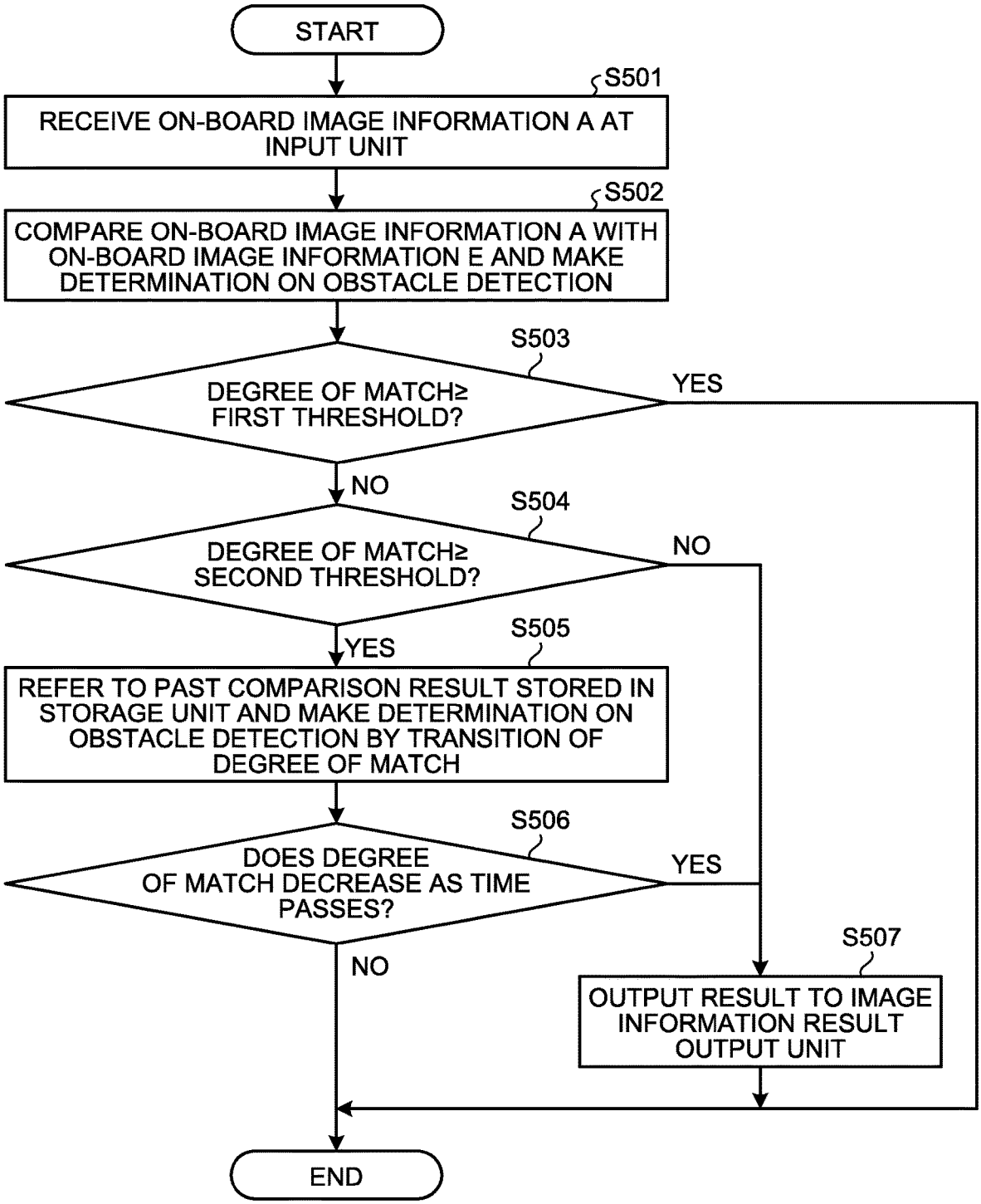
FIG. 13 is a flowchart illustrating an operation of the obstacle detection device of the train control system according to the third embodiment.

An operation of obstacle detection performed by the obstacle detection device 300 used in the train control system according to the third embodiment will be described. FIG. 13 is a flowchart illustrating the operation of obstacle detection performed by the obstacle detection device 300 used in the train control system according to the third embodiment. First, the input unit 102 receives the on-board image information A output from the train 10 (S501). Next, the image information comparison unit 301 compares on-board image information A with on-board image information E, and makes a determination on obstacle detection (S502).

The on-board image information E is past on-board image information received from the image information storage unit 103. The on-board image information A and the on-board image information E have the same train location information. That is, the on-board image information A and the on-board image information E are image information captured at the same train location. Moreover, the on-board image information E may be image information captured by the train 10 that has generated the on-board image information A, or may be image information captured by a preceding train running in front of the train 10 that has generated the on-board image information A. In other words, train ID information added to the on-board image information A and E may be the same or different. In the following description, the past image information captured by the train 10 that has generated the on-board image information A will be referred to as the on-board image information E.

The image information comparison unit 301 compares the on-board image information A with the on-board image information E, and makes a determination on obstacle detection in accordance with the degree of match. Specifically, the on-board image information A is compared with the on-board image information E, and it is determined whether or not the degree of match therebetween is greater than or equal to a predetermined first threshold. If the degree of match is greater than or equal to the first threshold (Yes in S503), the obstacle detection is ended determining that there is no obstacle. If the degree of match is less than the first threshold (No in S503), it is determined whether or not the degree of match is greater than or equal to a predetermined second threshold (S504). The second threshold is a value smaller than the first threshold. If the degree of match is less than the second threshold (No in S504), it is determined that an obstacle has been detected, and a result indicating the obstacle detection is output to the image information result output unit 104 (S507). The processing after the result indicating the obstacle detection has been output to the image information result output unit 104 is similar to that of the first embodiment. If the degree of match is less than the first threshold but greater than or equal to the second threshold (Yes in S504), the image information comparison unit 301 makes a determination on obstacle detection according to a transition of the degree of match (S505).

The image information comparison unit 301 refers to past comparison results stored in the comparison result storage unit 305. Specifically, the image information comparison unit 301 refers to results of image information comparison for on-board image information A1 generated immediately before the on-board image information A, and for on-board image information A2 generated before the on-board image information A and A1. For example, results of the degree of match are referred to as the results of image information comparison. The train ID information added to the on-board image information A, A1, and A2 is the same.

For example, it is assumed that the results of image information comparison (the degrees of match) for the on-board image information A, A1, and A2 are 94%, 95%, and 96%, respectively. In other words, it is assumed that the degree of match for the on-board image information A2 compared before the on-board image information A and A1 is 96%, the degree of match for the on-board image information A1 compared immediately before the on-board image information A is 95%, and the degree of match for the on-board image information A compared this time is 94%. In this case, the degree of match decreases in value as time passes.

The image information comparison unit 301 refers to the past comparison results stored in the comparison result storage unit 305, and determines that an obstacle has been detected if the degree of match decreases in value as time passes (Yes in S506), whereby a result indicating the obstacle detection is output to the image information result output unit 104 (S507). The image information comparison unit 301 refers to the past comparison results stored in the comparison result storage unit 305, and determines that there is no obstacle if the degree of match does not decrease in value as time passes (No in S506), whereby the obstacle detection is ended.

Figure 14:
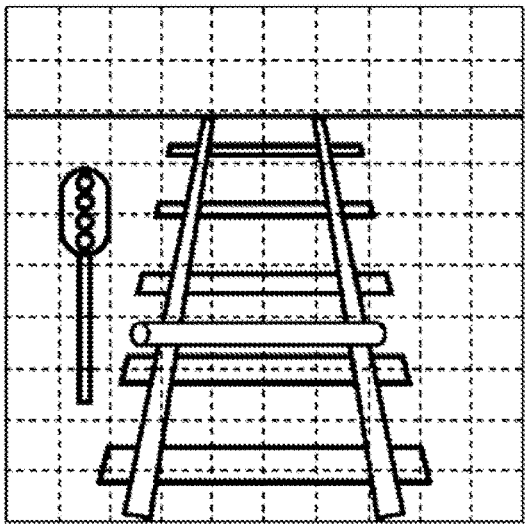
FIGS. 14(*a*)-14(*c*) are diagrams illustrating an example of on-board image information of the train control system according to the third embodiment.
Figure 14:
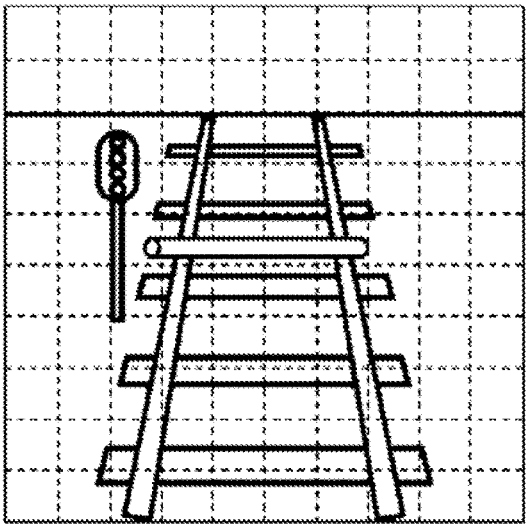
Figure 14:
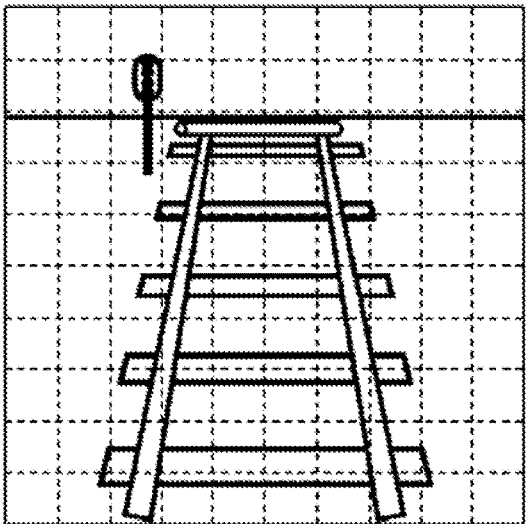

FIGS. 14(*a*)-14(*c*) are diagrams for explaining obstacle detection by the train control system according to the third embodiment. FIG. 14(*a*) is a diagram illustrating the on-board image information A. FIG. 14(*b*) is a diagram illustrating the on-board image information A1. FIG. 14(*c*) is a diagram illustrating the on-board image information A2.

The image information comparison unit 301 performs image information comparison on the on-board image information A and determines, as a result, that the on-board image information does not match in six areas corresponding to (3, 4), (4, 4), . . . , and (8, 4) and that the degree of match is 94%. Similarly, the image information comparison unit 301 performs image information comparison on the on-board image information A1 and determines, as a result, that the on-board image information does not match in five areas corresponding to (3, 6), (4, 6), . . . , and (7, 6) and that the degree of match is 95%. Similarly, the image information comparison unit 301 performs image information comparison on the on-board image information A2 and determines, as a result, that the on-board image information does not match in four areas corresponding to (4, 8), (5, 8), (6, 8), and (7, 8) and that the degree of match is 96%.

Figures 15, 16:
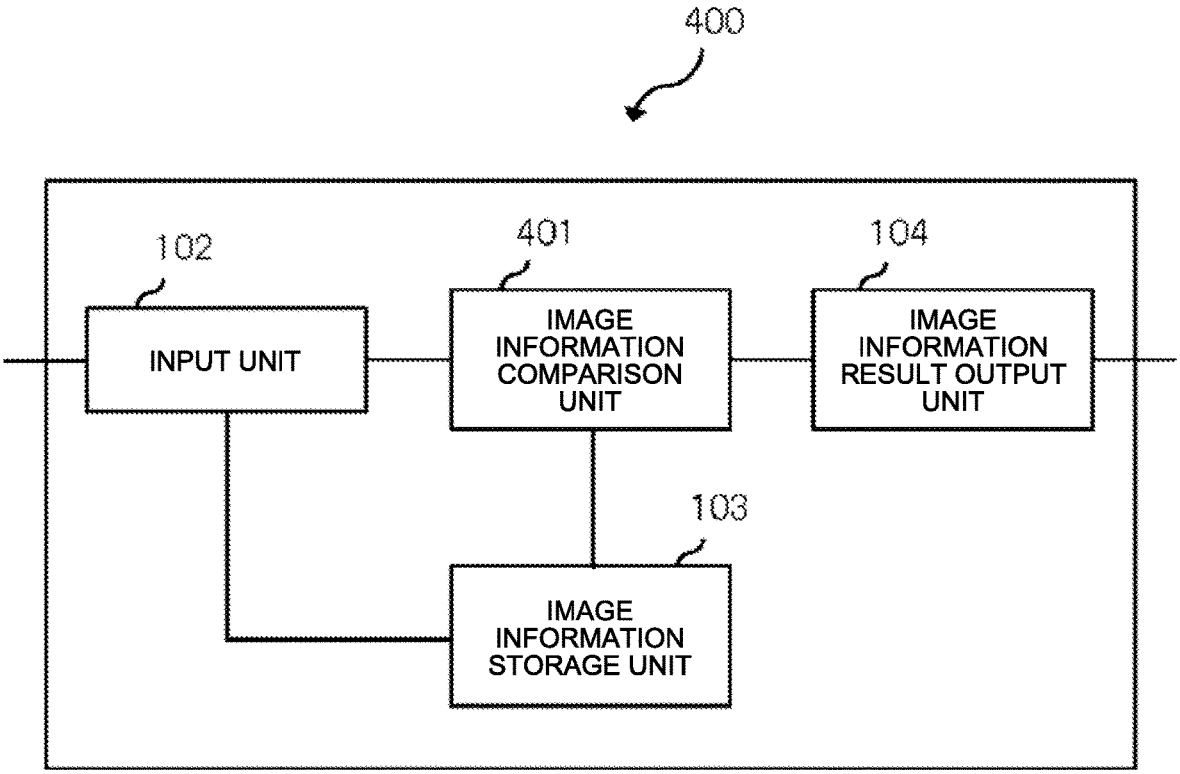
FIG. 15 is a table illustrating a history of the on-board image information of the train control system according to the third embodiment.
FIG. 16 is a diagram illustrating a configuration of an obstacle detection device of the train control system according to a fourth embodiment.

FIG. 15 is a table illustrating a history of the on-board image information of the train control system according to the third embodiment. FIG. 15 illustrates an example of the time at which each of the on-board image information A, A1, and A2 is captured, an example of the train location at which each of the on-board image information A, A1, and A2 is captured, and an example of the degree of match for each of the on-board image information A, A1, and A2. As can be seen from FIG. 15, the pieces of on-board image information A, A1, and A2 are captured at different times and train locations. Also, the pieces of on-board image information in FIG. 15 are captured in the order of the on-board image information A2, A1, and A.

As can be seen from FIG. 14, since the train 10 is running, the distance between the train 10 and an obstacle gets shorter as time passes. As the distance between the train 10 and the obstacle gets shorter, the number of areas of the image information of the obstacle with respect to all the image information areas increases. In a comparison between the on-board image information A2 and A1 in FIG. 14, the number of areas of the image information of the obstacle with respect to all the image information areas is larger in the on-board image information A1. Moreover, in a comparison between the on-board image information A1 and A, the number of areas of the image information of the obstacle with respect to all the image information areas is larger in the on-board image information A. As time passes, the number of areas of the image information of the obstacle with respect to all the image information areas increases. That is, the degree of match with the case where there is no obstacle decreases as time passes.

The third embodiment makes the determination on obstacle detection using the on-board image information having the same train ID information and different train location information. Specifically, the obstacle is detected by making the determination on obstacle detection using the transition of the results of comparison (degrees of match) of the image information that is generated by the train 10 having the same train ID information and has different train locations. The use of the image information having the same train ID information allows for comparison based on the image information obtained by the same imaging device, so that more accurate obstacle detection can be performed.

In the above description, the determination is made using the transition of the three degrees of match, which includes the degree of match preceding the current and previous degree of match up to the current degree of match, but the transition of two or four or more degrees of match may be used. In order to reduce false determinations, it is preferable to use the transition of three or more degrees of match. As for the decrease in value of the degree of match as time passes, the value need not decrease continuously but need only decrease overall.

In the train control system according to the third embodiment, the image information comparison unit 301 performs obstacle detection on the basis of the transition of the degrees of match when the degree of match is greater than or equal to the second threshold and less than the first threshold, whereby the capacity of the storage device mounted on the train 10 for performing obstacle detection can be reduced. Also, the comparison can be made on the basis of the image information from the same imaging device, whereby more accurate obstacle detection can be performed.

Furthermore, in the train control system according to the third embodiment, the image information comparison unit 301 determines that an obstacle has been detected when the degree of match decreases as time passes, whereby the capacity of the storage device mounted on the train 10 for performing obstacle detection can be reduced. Also, the comparison can be made on the basis of the image information from the same imaging device, whereby more accurate obstacle detection can be performed.

Fourth Embodiment

A fourth embodiment is characterized in that, when comparing the on-board image information, an obstacle detection device 400 compares train speed information and train acceleration information added to the on-board image information.

FIG. 16 is a diagram illustrating a configuration of the obstacle detection device 400 of the train control system according to the fourth embodiment. Note that although FIG. 16 illustrates only devices required for describing the train control system according to the fourth embodiment, other devices and functions may be mounted.

The obstacle detection device 400 illustrated in FIG. 16 includes the input unit 102, the image information storage unit 103, an image information comparison unit 401, and the image information result output unit 104. The basic configuration of FIG. 16 is similar to that of FIG. 3.

Figure 17:
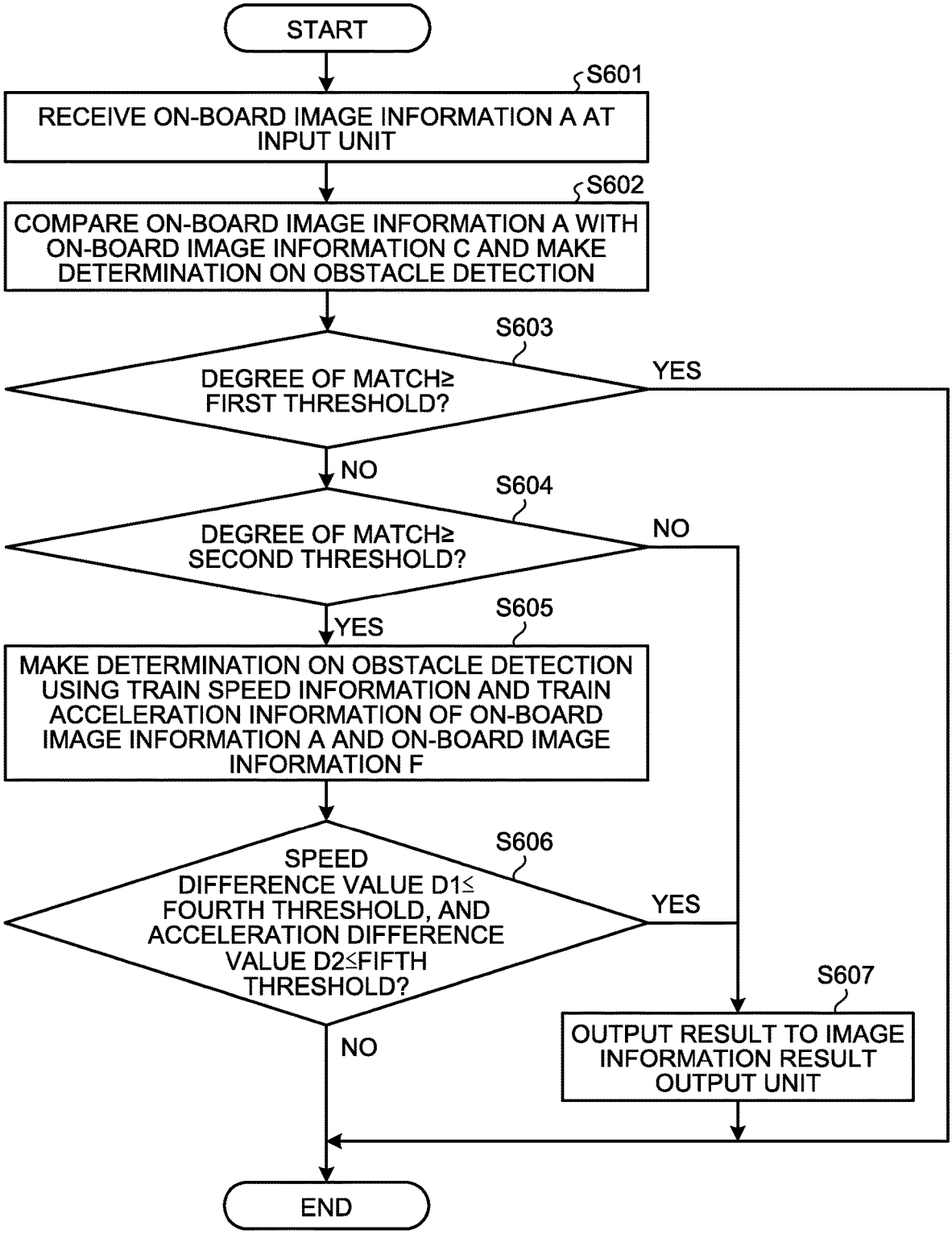
FIG. 17 is a flowchart illustrating an operation of the obstacle detection device of the train control system according to the fourth embodiment.

An operation of obstacle detection performed by the obstacle detection device 400 used in the train control system according to the fourth embodiment will be described. FIG. 17 is a flowchart illustrating the operation of obstacle detection performed by the obstacle detection device 400 used in the train control system according to the fourth embodiment. First, the input unit 102 receives the on-board image information A output from the train 10 (S601). Next, the image information comparison unit 401 compares on-board image information A with on-board image information F, and makes a determination on obstacle detection (S602).

The on-board image information F is past on-board image information received from the image information storage unit 103. The on-board image information A and the on-board image information F have the same train ID information and train location information.

The image information comparison unit 401 compares the on-board image information A with the on-board image information F, and makes a determination on obstacle detection in accordance with the degree of match. Specifically, the on-board image information A is compared with the on-board image information F, and it is determined whether or not the degree of match therebetween is greater than or equal to a predetermined first threshold. If the degree of match is greater than or equal to the first threshold (Yes in S603), the obstacle detection is ended determining that there is no obstacle. If the degree of match is less than the first threshold (No in S603), it is determined whether or not the degree of match is greater than or equal to a predetermined second threshold (S604). The second threshold is a value smaller than the first threshold. If the degree of match is less than the second threshold (No in S604), it is determined that an obstacle has been detected, and a result indicating the obstacle detection is output to the image information result output unit 104 (S607). The processing after the result indicating the obstacle detection has been output to the image information result output unit 104 is similar to that of the first embodiment. If the degree of match is less than the first threshold but greater than or equal to the second threshold (Yes in S604), a determination on obstacle detection is made using the train speed information and the train acceleration information added to the on-board image information A and the on-board image information F (S605).

The image information comparison unit 401 compares the train speed information between the on-board image information A and the on-board image information F, and calculates a difference. Similarly, the image information comparison unit 401 compares the train acceleration information between the on-board image information A and the on-board image information F, and calculates a difference. Here, the difference value calculated for the train speed information and the difference value calculated for the train acceleration information are denoted as D1 and D2, respectively.

The image information comparison unit 401 determines whether or not the difference value D1 in the train speed information is less than or equal to a predetermined fourth threshold. Similarly, the image information comparison unit 401 determines whether or not the difference value D2 in the train acceleration information is less than or equal to a predetermined fifth threshold. If the difference value D1 in the train speed information is less than or equal to the fourth threshold, and the difference value D2 in the train acceleration information is less than or equal to the fifth threshold (Yes in S606), it is determined that an obstacle has been detected, and a result indicating the obstacle detection is output to the image information result output unit 104 (S607). If the difference value D1 in the train speed information is greater than the fourth threshold (No in S606), or if the difference value D2 in the train acceleration information is greater than the fifth threshold (No in S606), it is determined that there is no obstacle, and the obstacle detection is ended.

When the difference value D1 in the train speed information is less than or equal to the fourth threshold and the difference value D2 in the train acceleration information is less than or equal to the fifth threshold, there is not much difference in the values of the train speed information and the values of the train acceleration information at the time the on-board image information A and the on-board image information F are generated, which means there is not much difference in the image capture conditions regarding the train speed and the train acceleration. That is, it is acknowledged that the pieces of image information with not much difference in the image capture conditions are compared. Therefore, although the degree of match is greater than or equal to the second threshold, the image information comparison unit 401 determines that an obstacle has been detected since the degree of match is less than the first threshold that is the threshold for determining obstacle detection.

The train control system according to the fourth embodiment compares the train speed information and the train acceleration information added to the on-board image information, and can thus take into consideration the difference in the image capture conditions for the on-board image information and improve the reliability of the result of comparison of the on-board image information.

In the train control system according to the fourth embodiment, when the degree of match is greater than or equal to the second threshold and less than the first threshold, the image information comparison unit 401 performs obstacle detection by comparing the train speed information between the first image information and the second image information as well as the train acceleration information between the first image information and the second image information, whereby the capacity of the storage device mounted on the train 10 for performing obstacle detection can be reduced. Also, the difference in the image capture conditions for the on-board image information can be considered, so that the reliability of the result of comparison of the on-board image information can be improved.

Figure 18:
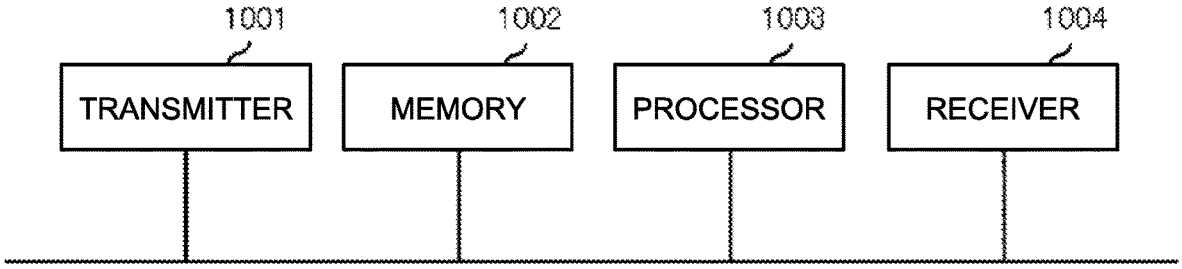
FIG. 18 is a diagram illustrating an example of a general configuration of hardware that implements the train control system according to each of the first to fourth embodiments.

Note that in the first to fourth embodiments described above, the image information conversion device 22 and the obstacle detection device 100 (200, 300, 400) each include at least a processor 1003, a memory 1002, a receiver 1004, and a transmitter 1001, and the operation of each device can be implemented by software. FIG. 18 is a diagram illustrating an example of a general configuration of hardware that implements each of the image information conversion device 22 and the obstacle detection device 100 (200, 300, 400) of the train control system according to each of the first to fourth embodiments. A device illustrated in FIG. 18 includes the processor 1003, a memory 1002, the receiver 1004, and the transmitter 1001, and the processor 1003 performs calculation and control by software using received data. The memory 1002 stores received data or data necessary when the processor 1003 performs calculation and control, and also stores software. The receiver 1004 is an interface that receives a signal or information input to the image information conversion device 22 or the obstacle detection device 100 (200, 300, 400). The transmitter 1001 is an interface that transmits a signal or information output from the image information conversion device 22 or the obstacle detection device 100 (200, 300, 400). Note that a plurality of each of the processors 1003, the memories 1002, the receivers 1004, and the transmitters 1001 may be provided.

Moreover, the embodiments can be combined as appropriate. For example, a combination of the second embodiment and the third embodiment can perform the determination twice using different pieces of image information with the same train location information, and can perform the determination based on the transition of the degrees of match for the image information that is generated by the train 10 having the same train ID information and has different train locations.

Note that the present invention is not limited to the above embodiments, and the embodiments can each be modified or omitted as appropriate without departing from the scope of the concept of the present invention.

REFERENCE SIGNS LIST

1 train control system; 10 train; 11 operation management device; 12 train control system network; 13 ground control device; 14 base network; 15 wireless base station; 16 ground unit; 17 track; 21 imaging device; 22 image information conversion device; 23 on-board information input/output device; 24 on-board wireless device; 25 on-board antenna; 26 on-board control device; on-board unit; 28 tachometer generator; 30 train control unit; 31 ground unit information receiving unit; storage unit; 100, 200, 300, 400 obstacle detection device; 101, 201, 301, 401 image information comparison unit; 102 input unit; 103 image information storage unit; 104 image information result output unit; 305 comparison result storage unit; 1001 transmitter; 1002 memory; 1003 processor; 1004 receiver.

The invention claimed is:

1. A train control system comprising:

an image information converter mounted on a train to output first image information that is obtained by adding train information to image information imaged by an imaging device mounted on the train and capable of capturing an area in front of the train, the imaging device configured to be adjustable such that the image information capturing the area in front of the train includes a position at which the train can be stopped from a maximum speed; and an obstacle detection device installed on the ground and wirelessly connected to the image information converter over a train control system network, the obstacle detection device including:

image information storage circuitry to wirelessly receive and record the first image information output from the image information converter;

movement authority circuitry to calculate a limit of movement at which the train is to be stopped based on at least the position at which the train can be stopped from a maximum speed in the first image information;

image information comparison circuitry to compare the first image information with second image information recorded in the image information storage circuitry;

image information result output circuitry to wirelessly output a result from the image information comparison circuitry to the train control system network, wherein the image information comparison circuitry determines a degree of match between the first image information and the second image information and, when the degree of match is greater than or equal to a second threshold and less than a first threshold, performs obstacle detection by comparing the first image information with third image information recorded in the image information storage circuitry; and the image information result output circuitry to wirelessly output a limit of movement result from the movement authority circuitry to the train control system network.

2. The train control system according to claim 1, wherein the image information comparison circuitry determines that an obstacle is detected when the degree of match is less than a third threshold.

3. A train control system comprising:

an image information converter mounted on a train to output first image information that is obtained by adding train information to image information imaged by an imaging device mounted on the train and capable of capturing an area in front of the train, the imaging device configured to be adjustable such that the image information capturing the area in front of the train includes a position at which the train can be stopped from a maximum speed; and an obstacle detection device installed on the ground and wirelessly connected to the image information converter over a train control system network, the obstacle detection device including:

image information storage circuitry to wirelessly receive and record the first image information output from the image information converter;

movement authority circuitry to calculate a limit of movement at which the train is to be stopped based on at least the position at which the train can be stopped from a maximum speed in the first image information;

image information comparison circuitry to compare the first image information with second image information recorded in the image information storage circuitry;

image information result output circuitry to wirelessly output a result from the image information comparison circuitry to the train control system network, wherein the image information comparison circuitry determines a degree of match between the first image information and the second image information and, when the degree of match is greater than or equal to a second threshold and less than a first threshold, performs obstacle detection on the basis of transition of the degree of match; and the image information result output circuitry to wirelessly output a limit of movement result from the movement authority circuitry to the train control system network.

4. The train control system according to claim 3, wherein the image information comparison circuitry determines that an obstacle is detected when the degree of match decreases as time passes.

5. The train control system according to claim 1, further comprising an operation controller to perform operation management on the train, wherein the operation controller sets a protected range for the train when receiving the result indicating obstacle detection output by the image information result output circuitry.

6. An obstacle detection device comprising:

image information storage circuitry installed on the ground to receive first image information captured from an area in front of a train over a train control system network and record the first image information, the first image information including a position at which the train can be stopped from a maximum speed;

movement authority circuitry to calculate a limit of movement at which the train is to be stopped based on at least the position at which the train can be stopped from a maximum speed in the first image information;

image information comparison circuitry to determine a degree of match of image information by comparing the first image information with second image information recorded in the image information storage circuitry, and perform a second round of obstacle detection when the degree of match is greater than or equal to a second threshold and less than a first threshold; and image information result output circuitry to wirelessly output a result from the image information comparison circuitry and a limit of movement result from the movement authority circuitry to the train control system network.

7. The obstacle detection device according to claim 6, wherein the image information comparison circuitry performs obstacle detection by comparing the first image information with third image information recorded in the image information storage circuitry.

8. The obstacle detection device according to claim 6, wherein the image information comparison circuitry performs obstacle detection on the basis of transition of the degree of match.

9. The obstacle detection device according to claim 6, wherein the image information comparison circuitry performs obstacle detection by comparing train speed information between the first image information and the second image information, and comparing train acceleration information between the first image information and the second image information.

10. The train control system according to claim 2, further comprising an operation controller to perform operation management on the train, wherein the operation controller sets a protected range for the train when receiving the result indicating obstacle detection output by the image information result output circuitry.

11. The train control system according to claim 3, further comprising an operation controller to perform operation management on the train, wherein the operation controller sets a protected range for the train when receiving the result indicating obstacle detection output by the image information result output circuitry.

12. The train control system according to claim 4, further comprising an operation controller to perform operation management on the train, wherein the operation controller sets a protected range for the train when receiving the result indicating obstacle detection output by the image information result output circuitry.

13. The obstacle detection device according to claim 7, wherein the image information comparison circuitry performs obstacle detection on the basis of transition of the degree of match.

14. The obstacle detection device according to claim 7, wherein the image information comparison circuitry performs obstacle detection by comparing train speed information between the first image information and the second image information, and comparing train acceleration information between the first image information and the second image information.

15. The obstacle detection device according to claim 8, wherein the image information comparison circuitry performs obstacle detection by comparing train speed information between the first image information and the second image information, and comparing train acceleration information between the first image information and the second image information.

16. The obstacle detection device according to claim 13, wherein the image information comparison circuitry performs obstacle detection by comparing train speed information between the first image information and the second image information, and comparing train acceleration information between the first image information and the second image information.

* * * * *